United States Patent [19]

Marconnet

[11] Patent Number: 4,988,207

[45] Date of Patent: Jan. 29, 1991

[54] DRYING/COATING DRUM FOR THE PREPARATION OF BITUMINOUS COATED PRODUCTS, COMPRISING AN IMPROVED BURNER

[75] Inventor: Guy Marconnet, Rive de Gier, France

[73] Assignee: Ermont C. M., Lorette, France

[21] Appl. No.: 503,862

[22] Filed: Apr. 3, 1990

[30] Foreign Application Priority Data

Apr. 5, 1989 [FR] France ..... 89 04475

[51] Int. Cl.[5] ..... B28C 5/46

[52] U.S. Cl. ..... 366/25; 366/58

[58] Field of Search ..... 366/4, 7, 12, 23, 24, 366/25, 144, 147, 54, 57, 58; 431/182, 183, 185; 106/273.1, 277

[56] References Cited

U.S. PATENT DOCUMENTS

| | | | |
|---|---|---|---|
| 2,421,345 | 5/1947 | McConaaughay | 366/25 |
| 3,329,131 | 7/1967 | Wright | 431/185 |
| 4,095,285 | 4/1978 | Malbrundt | 366/23 |
| 4,787,938 | 11/1988 | Hawkins . | |

FOREIGN PATENT DOCUMENTS

WO8808052 10/1988 PCT Int'l Appl. .

*Primary Examiner*—Robert W. Jenkins

*Attorney, Agent, or Firm*—Pollock, Vande Sande & Priddy

[57] ABSTRACT

The drying/coating drum comprising a burner (20) whose body (19) penetrates via the discharge end (3) of the drum into a zone which is distant from this end. The gases and the solid materials circulate countercurrent-wise in the drum. The body (19) of the burner (20), fixed relative to the drum (1), is disposed inside an outer peripheral sleeve (22) which is free in rotation about the body (19) of the burner (20). The outer sleeve (22) is connected to the casing (1) of the drum. The end of the outer sleeve (22) corresponding to the end (19*a*) of the burner from which the flame (14) develops carries a plurality of radially directed blades (25, 26) forming a turbine for sucking gas into the mixing zone (30) and a screen against radiation from the flame (14) of the burner (20) during rotation of the drum.

9 Claims, 3 Drawing Sheets

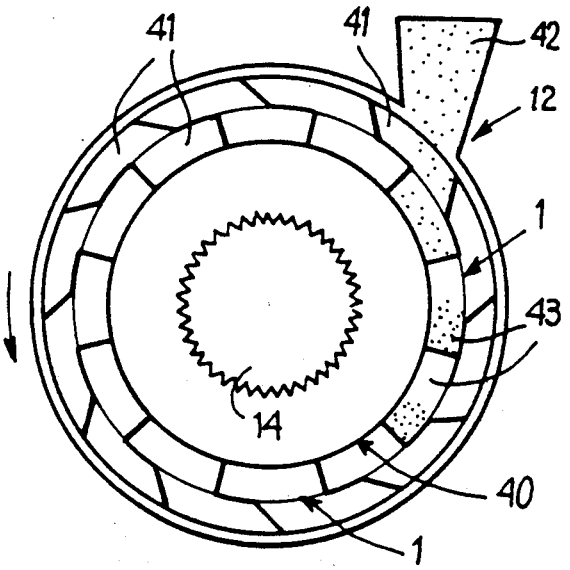
FIG.6
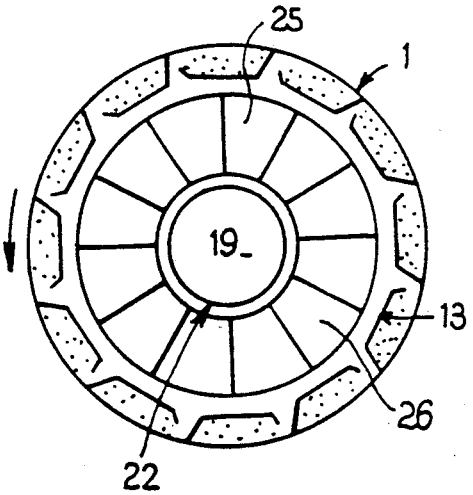
FIG.7
FIG.8
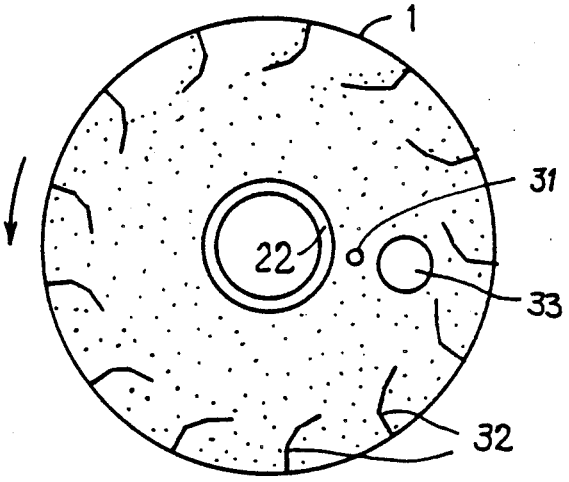

DRYING/COATING DRUM FOR THE PREPARATION OF BITUMINOUS COATED PRODUCTS, COMPRISING AN IMPROVED BURNER

The invention relates to a drying and coating drum for the preparation of bituminous coated products, comprising an improved burner.

Devices are known for the preparation of bituminous coated products from aggregates and bitumen which consist of a drum comprising a cylindrical casing in which the aggregates introduced via one end of the drum are dried and heated and the dried and heated aggregates are coated with bitumen which is generally introduced in liquid form.

It is also possible to introduce a certain quantity of used coated products in crushed form into the drum so as to incorporate them with the fresh aggregates introduced via one end of the drum.

Drying/coating drums are generally fitted on the inside with fins for lifting or stirring the materials, and the drum whose axis is slightly tilted in the direction from its intake end towards its discharge end conveys solid materials when it is rotated about its longitudinal axis.

The solid materials consisting principally of aggregates are thus circulated in the longitudinal direction of the drum and are successively dried and heated and then coated with bitumen.

The heat needed to dry and heat the aggregates and/or remelt recycled coated products is supplied to the drum by a burner penetrating axially via one of the ends of the casing.

The burner may be introduced into the casing via its end which receives the fresh aggregates, which is generally designated the intake end. In this case, the hot gases coming from the burner and the aggregates circulate in the same direction inside the drum.

It is also possible to introduce the burner via the longitudinal end of the casing of the drum opposite its intake end and, in this case, the hot gases circulate countercurrentwise relative to the aggregates inside the casing of the drum. This arrangement of the burner with countercurrentwise circulation of the hot gases has advantages if the burner has a very long body disposed axially in the drum insofar as the end of the body from which the flame develops is in a zone distant from the discharge end of the drum.

The drum is thus, overall, separated into two zones, namely a first zone located between the intake end of the drum and the end of the burner, in which the flame of the burner develops and in which the hot gases circulate, and a second zone located about the body of the burner between the end of the burner and the discharge end of the drum, this second zone not being subject to the circulation of the hot gases coming from the burner. This arrangement makes it possible to dry and heat aggregates in the first zone and coat the dried and heated aggregates in the second zone while reducing the risks of the bitumen degrading and igniting These risks are further reduced if a diaphragm is disposed in the transverse section of the drum in order to separate the flame zone from the coating zone. Such diaphragms, however, have the drawback of reducing the section for passage of the aggregates through the drum; moreover, in operation, these diaphragms suffer stresses and shocks which lead to their more or less rapid destruction.

A drying/coating drum with circulation of the gases countercurrentwise to the solid materials and comprising an additional fan with a large throughput intended to suck the bitumen vapours into the coating zone is also known. This large-throughput suction tends to favour the formation of vapour and to entrain pulverulent materials introduced into the drum pneumatically towards the burner. The latter thus tends to clog up.

In order to prevent too great a quantity of dust being sucked in, use is made of a chamber in which the pulverulent materials are mixed with bitumen. However, this favours the formation of bitumen vapour and pellets consisting of a mixture of pulverulent material and bitumen which is highly detrimental to the quality of the coated products produced. Moreover, in such a drying-/coating drum, mixing is performed in contact with the base of the drum, which has an adverse effect on the quality of the coated product produced.

Finally, the extraction fan conveys all the water vapour contained in the recycled materials and passes it over the new bitumen, which favours distillation and vaporization of the bitumen by the "steam cracking" phenomenon.

In the case of drums with circulation of gases countercurrentwise relative to the solid materials and with an advanced burner, a device was not hitherto known which was efficient, strong and compact and which made it possible to separate the flame zone from the coating zone and to remove the volatile materials produced during the heating of the bitumen in the coating zone.

The invention thus aims to propose a drying and coating drum for the preparation of bituminous coated products from aggregates and bitumen, the drum having a casing of cylindrical form comprising a first end, or intake end, via which at least part of the aggregates are introduced, and a second end, or discharge end, via which the body of a burner penetrates into the drum in its axial direction up to a zone which is distant from the discharge end so as to develop a flame and to circulate hot gases along the drum, in the direction opposite to the direction of circulation of the aggregates, from the end of the body of the burner, a means for injecting bitumen disposed so as to emerge in a coating zone of the drum located around the body of the burner and means for rotating the drum about its axis, this drying and coating drum comprising a mixing zone around the body of the burner which is perfectly insulated from the flame zone when the drum is in operation and removing volatile products released by the bitumen in the mixing zone.

To this end, the part of the body of the burner located inside the drum is disposed coaxially inside an outer peripheral sleeve, free in rotation about the body of the burner and connected to the casing of the drum, one end of which, corresponding to the end of the burned from which the flame develops, carries a plurality of blades which are radially directed relative to the casing of the drum and have faces which are tilted relative to the longitudinal direction of the drum and form a turbine for sucking gas in the direction from the second towards the first end during rotation of the drum and a screen against radiation from the flame of the burner.

In order to facilitate comprehension of the invention, a description will now be given, by way of non-limiting example and with reference to the figures appended as an annex, of an embodiment of a drying/coating drum according to the invention.

FIG. 6 is a view in transverse section along 6—6 in FIG. 1.

FIG. 7 is a view in transverse section along 7—7 in FIG. 1.

FIG. 8 is a view in transverse section along 8—8 in FIG. 1.

Figure 1:
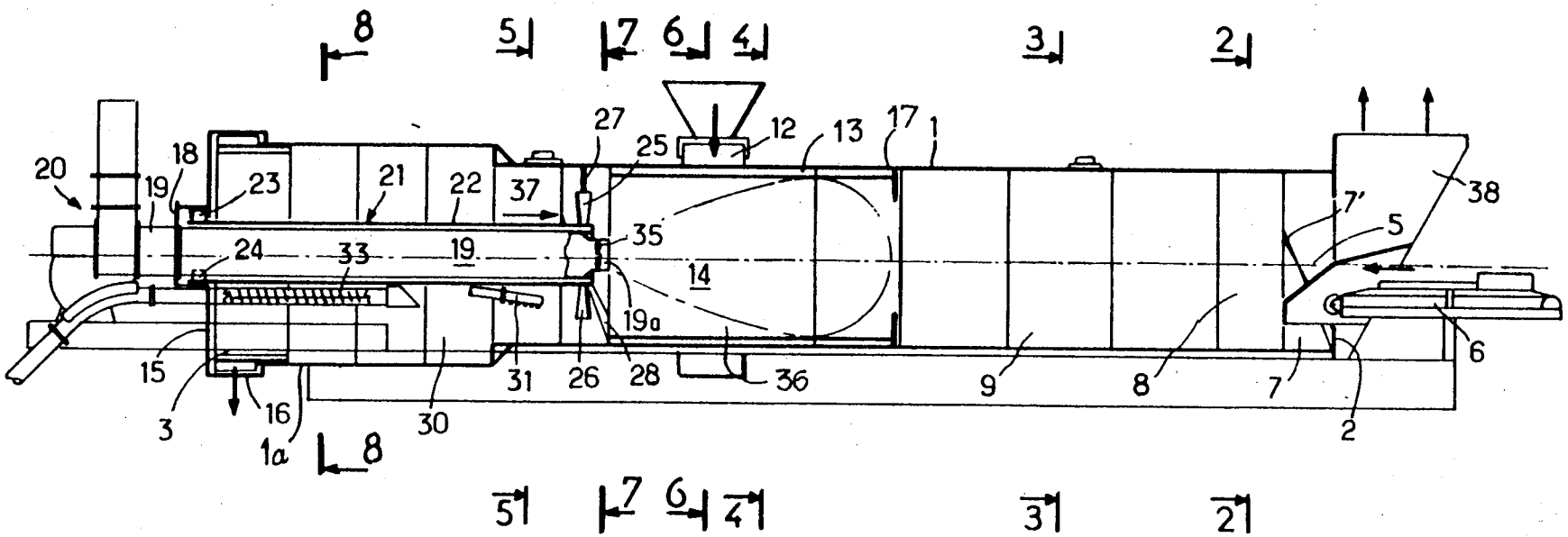
FIG. 1 is a view in axial section of the drying/coating drum assembly.
Figure 3:
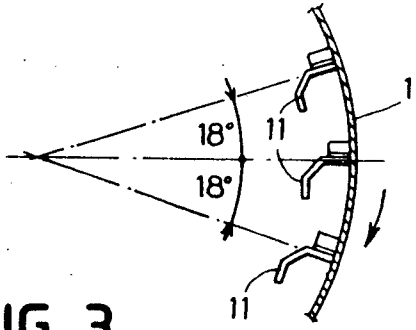
FIG. 3 is a view in partial transverse section along 3—3 in FIG. 1.

The drying/coating drum shown in FIG. 1 comprises a casing 1 of overall cylindrical form comprising a first end 2, forming its intake end, and a second end 3, forming its discharge end.

In the operating position of the drum, the casing 1 is mounted on a platform so that its longitudinal axis 5 is tilted relative to the horizontal, the intake end 2 being at a level which is higher than the level of the discharge end 3. The casing 1 is also mounted so as to rotate on the platform, about its longitudinal axis 5.

The platform and the elements permitting rotary mounting and rotary driving of the casing 1 have not been shown since these elements are customary in the field of construction of drying/coating drums.

A device 6 for conveying and unloading aggregates penetrates via the intake end 2 of the drum, said aggregates thus being unloaded into an introduction zone 7 in which the inner surface of the drum is fitted with blades 7' projecting radially inwards which wind helically over the surface of the drum.

The blades 7' disposed in propeller screw form make it possible to introduce aggregates very rapidly into the second zone 8 of the drum.

Figure 2:
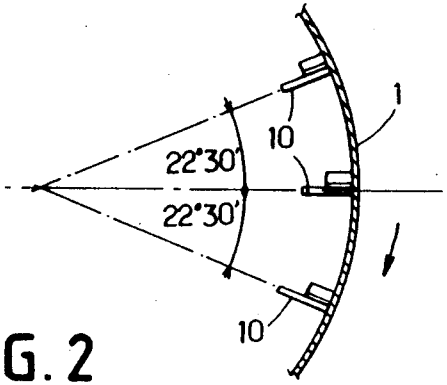
FIG. 2 is a view in partial transverse section along 2—2 in FIG. 1.

In this zone 8, as may be seen in FIG. 2, the casing 1 carries, on its inner surface, flat blades 10 which make it possible to stir the aggregates to a certain extent without lifting these aggregates inside the drum.

After zones 7 and 8 in which the aggregates remain in contact with the inner surface of the drum, the drying-/coating drum comprises a zone 9 in which the inner surface of the casing 1 is fitted with blades 11 in the form of hooks which make it possible to lift the aggregates to a certain extent inside the drum during rotation thereof. This zone 9 forms a drying and heating zone, the aggregates being exposed to the radiation of the flame and being brought into contact with the hot gases circulating in the drum.

The drying and heating zone 9 occupies a substantial length of the drum and ends at an annular diaphragm 17 limiting the zone in which the flame 14 of the burner develops. Downstream of the diaphragm 17, in the first part of the flame zone, a recycling ring 12 is disposed around the drum so as to permit the introduction of recycled materials into the drum.

Figure 4:
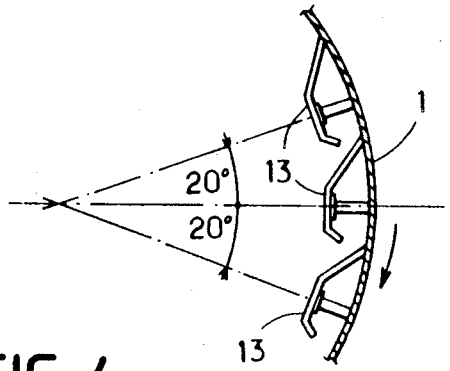
FIG. 4 is a view in partial transverse section along 4—4 in FIG. 1.

As may be seen in FIG. 4, the inner surface of the casing 1 of the drum comprises, in the zone located between the diaphragm 17 and the recycling ring 12, antiradiation blades 13 whose form makes it possible to protect the materials introduced into the drum against the radiation of the flame. The blades 13 delimit, with the inner surface of the casing 1, a succession of pockets of which that wall which is directed towards the inside of the drum, that is to say towards the flame 14 of the burner, prevents direct exposure of the materials.

The part 1*a* of the casing 1 disposed in the vicinity of the discharge end 3 has a diameter which is greater than the diameter of the other parts of the casing.

This part 1*a* is engaged, via its end adjacent to the discharge section 3, in a front element 15 comprising a discharge opening 16 for the coated products prepared in the drum.

On the front 15 is also fixed, in a central position, a support 18 in which is engaged the fixed body 19 of the burner 20 penetrating via the discharge end of the drying/coating drum.

The body 19 of the burner 20 which is fixed in rotation relative to the casing 1 of the drum penetrates inside the casing 1 in the axial direction thereof. The part of the body 19 which is located inside the drum is disposed axially inside an outer peripheral sleeve 22 which is free in rotation about the body 19. The sleeve 22 is mounted so as to rotate inside the support 18 by means of rollers 23 and about the body 19 of the burner by means of rollers 24.

The fuel and the combustion air are supplied to the burner via the inside of the body 19 which comprises a discharge end 19*a* from which the flame 14 develops.

Blades, such as the blades 25 and 26, are fixed on the outer surface of the sleeve 22 and in radial directions, in positions adjacent to the end of the sleeve 22 corresponding to the end 19*a* of the body of the burner.

The sleeve 22 is also fixed on the casing 1 of the drying/coating drum by means of lugs 27 welded on the end of the blades, such as 25, and on the inner surface of the casing 1.

The blades 25 and 26 are tilted relative to the longitudinal axis 5 of the drum at an angle other than 90° so that these blades, during rotation of the drum, form a turbine which enables the gases located in the part of the drum which is located between the discharge end 3 of this drum and the end of the burner around which the blades 25, 26 are fixed, to be sucked through.

In FIG. 7, it is seen that the projected surfaces of the blades 25, 26 cover the entire cross section of the drum in its central zone corresponding to the zone where the flame develops. The blades 25, 26 thus form an antiradiation screen separating the flame zone from the zone located downstream around the forward body 19 of the burner 20.

Blades in the form of propellers 28 are fixed on the inner surface of the casing 1 of the drum, immediately upstream of the blades 25, 26 integral with the sleeve 22. These propeller-type blades 28 convey materials from upstream to downstream in the turbine formed by the blades 25, 26.

The body 21 of the burner 20 has a relatively large length so that the end of the burner from which the flame 14 develops is in a distant position relative to the discharge end 3 of the drum. The zone of the drum through which the body of the burner penetrates forms, in its peripheral part, that is to say between the outer sleeve 22 and the casing 1, 1*a* of the drum, the coating zone 30 of the drum in which the head 31 of the bitumen-injecting device emerges. This injecting head 31 is located downstream of the end part 19*a* of the body of the burner 19, that is to say downstream of the blades 25 and 26.

Figure 5:
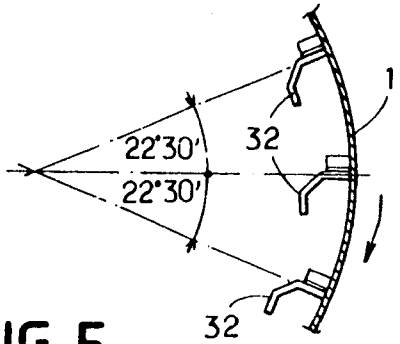
FIG. 5 is a view in partial transverse section along 5—5 in FIG. 1.

As may be seen in FIGS. 5 and 8, in the zone 30, the inner surface of the casing 1 of the drying/coating drum carries hook-blades 32 which lift the materials across the entire cross-section of the drum in order to efficiently mix the aggregates and the bitumen and produce homogeneous and maleable coated products A curtain of materials falling down across the entire cross-section of the drum is formed immediately downstream of the blades 25, 26 and upstream of the nozzle 31.

A nozzle 33 for injecting pulverulent material consisting of an endless screw is also disposed inside the zone 30 and emerges in this zone, downstream of the nozzle 31 for injecting bitumen. The pulverulent materials thus come into contact with solid materials which are covered with bitumen. The pulverulent materials thus adhere to the aggregates and cannot fly away inside the drum. A double coating is thus achieved; in a first stage, the aggregates with a large particle size are coated with bitumen by the nozzle 31. These aggregates include few fines, since these have been separated and entrained by the gases circulating in the drum in the drying zone (8, 9). The aggregates with a large particle size are coated efficiently and bitumen is added in a zone which is perfectly insulated from the flame zone and in which no air current or water vapour current circulates. This prevents oxidation and "steam cracking" of the bitumen.

Elements with a fine particle size are introduced via the nozzle 33 consisting of an endless screw. These fine elements are tipped onto the elements with a large particle size which have been coated in the first part of the zone 30. This prevents any formation of pellets consisting of fine elements and bitumen. Moreover, the aggregates with a large particle size coated with bitumen which rain down in the first part of the zone 30 make it possible to retain by adhesion the fines which would tend to propagate upstream in the drum.

At the end 19*a* of the body 19 of the burner from which the flame 14 is formed, is disposed a spray 35 which splits up the fuel introduced into the central part of the body of the burner and produces an intimate mixture with the combustion air. A flame 14 is thus obtained at the outlet 19*a* of the burner, which flame extends inside the drum over a certain length corresponding to the zone in which the recycled products are introduced and to an intermediate zone 36 between the drying and heating zone and the mixing zone 30.

When the drying/coating drum is in operation, the casing 1 is rotated about its longitudinal axis 5, which also drives the outer sleeve 22, and the blades 25 and 26 fixed on the outer sleeve, in rotation about the burner 20.

These blades form the blades of a turbine which, to a certain extent, sucks the gases located in the zone 30 in the direction of the flame zone (arrow 37).

The volatile parts of the bituminous materials introduced into the zone 30 and separated under the action of the heat of the aggregates penetrating into this zone are thus sucked by the blades 25, 26 of the turbine, circulated and mixed with the flame 14 of the burner and thus eliminated by combustion.

The hot gases passing through the drum emerge via the intake end 2 of the casing 1 of the drum and are removed by a recovery device 38.

The operation of the drying and coating drum according to the invention will be described below.

Fresh cold and damp aggregates are introduced into the drum by the device 6. These aggregates unloaded into the zone 7 are conveyed rapidly by the propellers 7, in the zone 8 comprising flat blades. The aggregates are then slowed down and conveyed at a slower speed in the direction of the drying zone 9.

In the drying and heating zone 9, the aggregates are lifted inside the drum and rain back down over a large part of the inner transverse section of the casing 1. The cold and damp aggregates are thus exposed to the hot gases circulating in the drum in the extension of the flame 14. The aggregates are thus intensely heated and dried and this is further increased when the aggregates reach the flame zone 14. In this zone, the aggregates become subject to the antiradiation blades 13. (See FIG. 4).

As may be seen in FIG. 6, the recycling ring 12 is located around the casing 1 of the drum which comprises chutes 41 for introducing recycled materials that have been unloaded into the hopper 42 of the recycling ring 12 via openings passing through the casing 1 of the drum. A second drum 40 of smaller diameter is arranged inside the casing 1 of the drum, in the recycling zone. Propeller blades 43 are fixed on the second drum 40 for the introduction of recycled materials downstream of the recycling ring behind the antiradiation blades 13. The fresh aggregates are also conveyed downstream of the recycling ring and mixed with the recycled coated products.

The flame 14 of the burner is pear-shaped, its diameter increasing gradually from the spray 35 up to the vicinity of its end portion. At the level of the recycling ring, the flame thus occupies only a central part of the cross-section of the drum. The recycled materials are thus not exposed directly to the flame upon entry into the drum.

The coated materials recycled at the level of the recycling ring 12 are incorporated with perfectly dry fresh aggregates and heated to a high temperature. The bitumen of the recycled materials is thus rapidly remelted in the last part of the flame zone 14. Moreover, any vapours released by the recycled materials are incinerated thanks to the annular diaphragm 17 which concentrates the hot gases at the outlet of the combustion zone.

Intense drying accompanies the heating of the aggregates and the water vapour formed escapes via the openings in the antiradiation blades 13. This water vapour is removed by the gas stream without coming into contact with the fresh bitumen. The mixture is thus virtually dry when it penetrates into the zone 30.

The fresh aggregates mixed with the remelted recycled coated products are introduced into the zone 30 where liquid bitumen is incorporated therewith by the injection nozzle 31.

The fins 32 lining the casing of the drum in the zone 30 make it possible to lift the aggregates across the entire cross-section of the drum and to mix and efficiently coat the aggregates in contact with the bitumen.

Moreover, on rotation of the drum, the blades 25 and 26 integral with the outer sleeve which is movable in rotation about the burner efficiently protect the materials containing the bitumen.

The volatile fractions separated from the bitumen under the action of the heat of the aggregates are sucked at the level of the blades 25 and 26 which are tilted relative to the axis of the drum and conveyed into the flame zone.

The screen effect of the blades 25 and 26 of the burner is increased by the presence of a curtain of materials falling across the entire cross-section of the drum inside the zone 30.

Pulverulent material is incorporated via the nozzle 33 with the bitumen-covered aggregates. This pulverulent material is thus retained by the aggregates by virtue of the adhesive power of the bitumen.

Mixing and coating continue throughout the zone 30 which is perfectly separated from the flame zone. There is thus no degradation of the bitumen and, consequently, coating takes place under satisfactory conditions.

The coated products are recovered at the outlet of the drum, at the level of the opening 16.

The drying and coating drum according to the invention thus makes it possible to provide good-quality coating in a zone which is perfectly separated from the flame zone of the drum, by virtue of a burner of improved design.

The invention is not restricted to the embodiment which has been described.

It is thus possible to imagine blades having a form other than the blades 25, 26 which have been described and that any number of these blades may be disposed around the outer sleeve surrounding the burner 20. The blades fixed on the inner surface of the drum may have a form other than that which has been described and shown.

The device according to the invention may be used equally for the preparation of bituminous coated products from fresh materials and recycled materials and for the preparation of coated products solely from fresh materials.

I claim:

1. A drying and coating drum for the preparation of bituminous coated products from aggregates and bitumen, the drum having a casing (1) of cylindrical form comprising a first end (2), or intake end, via which at least part of the aggregates are introduced, and a second end (3), or discharge end, via which the body (19) of a burner (20) penetrates into the drum in its axial direction up to a zone which is distant from the discharge end (3) so as to develop a flame; (14) and to circulate hot gases along the drum, in the direction opposite to the direction of circulation of the aggregates, from the end (19*a*) of the body (19) of the burner, a means (31) for injecting bitumen disposed so as to emerge in a coating zone (30) of the drum located around the body (19) of the burner (20) and means for rotating the drum about its axis (5), wherein the part of the body (19) of the burner (20) located inside the drum is disposed coaxially inside an outer peripheral sleeve (22), free in rotation about the body (19) of the burner and connected to the casing (1) of the drum, one end of which, corresponding to the end of the burner (20) from which the flame (14) develops, carries a plurality of blades (25, 26) which are radially directed relative to the casing (1) of the drum and have faces which are tilted relative to the longitudinal direction (5) of the drum and form a turbine for sucking gas in the direction from the second to the first end of the drum during rotation of the drum and a screen against radiation from the flame (14) of the burner (20).

2. The drum as claimed in claim 1, wherein the projected surface of the blades (25, 26) in a cross-section plane of the drum is substantially identical to the cross section of the flame (14) of the burner in its zone of largest section.

3. The drum as claimed in claim 1, wherein the outer sleeve (22) surrounding the burner (20) is fixed to the casing (1) of the drum by means of at least one blade (25).

4. The drum as claimed in claim 1, wherein the outer sleeve (22) of the burner (20) is mounted so as to rotate inside a fixed element (15) by means of rollers (23) and around the body (19) of the burner by means of rollers (24).

5. The drum as claimed in claim 1 which comprises, fixed on the inner surface of its casing (1*a*), in the coating zone (30) located around the burner, blades (32) lifting the solid materials in circulation across the entire cross-section of the drum.

6. The drum as claimed in claim 1 which comprises, between its intake end (2) and the zone in which the flame (14) develops, a drying zone (8, 9) separated from the flame zone by an annular diaphragm (17).

7. The drum as claimed in claim 6, which comprises a ring (12) for introducing recycled materials between the drying zone (8, 9) and the end (19*a*) of the burner (20) from which the flame (14) is formed.

8. The drum as claimed in claim 7, which comprises, fixed on the inner surface of its casing (1), in the flame zone, between the diaphragm (17) and the end of the burner (20) about which the blades (25, 26) of the turbine are disposed, antiradiation blades conveying the solid materials in circulation in the drum and protecting these materials against radiation of the flame.

9. The drum as claimed in claim 1, which comprises a device (33) for introducing pulverulent materials emerging inside the zone located around the body (19) of the burner (20), downstream of the bitumen-injecting means (31).

* * * * *